US007228938B1

(12) United States Patent
Mitchell

(10) Patent No.: US 7,228,938 B1
(45) Date of Patent: Jun. 12, 2007

(54) OUTRIGGER ASSEMBLY FOR SUPPORTING A PLATFORM ADJACENT A WORK AREA

(76) Inventor: Kenneth W. Mitchell, 11602 Highway 48, Wedowee, AL (US) 36278

( * ) Notice: Subject to any disclaimer, the term of this patent is extended or adjusted under 35 U.S.C. 154(b) by 384 days.

(21) Appl. No.: 10/991,153

(22) Filed: Nov. 18, 2004

(51) Int. Cl.
*E04G 3/00* (2006.01)

(52) U.S. Cl. ..... 182/82; 182/113; 182/222; 256/59

(58) Field of Classification Search ..... 182/82, 182/113, 222; 256/59
See application file for complete search history.

(56) References Cited

U.S. PATENT DOCUMENTS 3,433,443 A 3/1969 Mangan et al.
3,480,257 A * 11/1969 Bourn ..... 256/59
3,863,900 A * 2/1975 Dagiel et al. ..... 256/59
3,881,698 A * 5/1975 Marsh ..... 256/59
4,669,577 A * 6/1987 Werner ..... 182/113
4,869,451 A 9/1989 Gordon
5,259,477 A 11/1993 Fears et al.
5,430,903 A * 7/1995 Pence ..... 14/7
D413,681 S 9/1999 Zumwalt
6,003,631 A 12/1999 Knauth
2002/0139614 A1 * 10/2002 Volkman ..... 182/82
2003/0127283 A1 7/2003 Deal

* cited by examiner

*Primary Examiner*—Alvin Chin-Shue

(57) ABSTRACT

An outrigger assembly includes at least one support unit including a first elongated support arm and a second elongated support arm cantilevered and secured to the first support arm. A joist-supporting arm is removably engaged with the front end portion. The assembly further includes an upper support arm cantilevered and secured to the first support arm. A support member having opposed end portions is secured thereto and to the first support member. The upper support arm includes a plurality of L-shaped members mated along an edge thereof. An elongated board is positionable between adjacently disposed rear end portions. The front end portion exerts an upward force against the work area joists while the upper support arm exerts a downward force against a top surface of the work area such that the forces become balanced.

18 Claims, 3 Drawing Sheets

OUTRIGGER ASSEMBLY FOR SUPPORTING A PLATFORM ADJACENT A WORK AREA

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to an outrigger assembly and, more particularly, to an outrigger assembly for supporting a platform adjacent to a work area.

2. Prior Art

As is generally well known in the building industry, it is often necessary during construction of a structure to support workers above the ground on a scaffold so they can conveniently reach and work on parts of the structure higher than they can reach from the ground. The prior art is replete with myriad and diverse wall supported scaffolding constructions. While all of the prior art constructions are more than adequate for the basic purpose and function for which they have been specifically designed, they are uniformly deficient with respect to their failure to provide a simple, efficient, and ruggedly constructed scaffold device that can easily and quickly be assembled and disassembled on site to assist roofers and framers in the performance of their appointed tasks.

As most individuals in the construction trades are all too well aware, the need for stable, ruggedly constructed scaffolding is an absolute necessity both for the safety and welfare of the workers, and also to facilitate the performance and completion of a variety of different tasks.

Accordingly, a need remains for an outrigger assembly for supporting a platform adjacent to a work area in order to overcome the above-noted shortcomings. The present invention satisfies such a need by providing an assembly that is safe to use, compact, portable and cost effective. Such an outrigger assembly is easy to set up and break down, thus resulting in time savings, an increased amount of work completed and improved productivity. The present invention provides superior support when compared to ladders, jacks and scaffoldings known in the industry. Commercial workers, as well as do-it-yourself enthusiasts, can appreciate the benefits of using the outrigger assembly for their construction projects.

BRIEF SUMMARY OF THE INVENTION

In view of the foregoing background, it is therefore an object of the present invention to provide an outrigger assembly for supporting a platform adjacent to a work area. These and other objects, features, and advantages of the invention are provided by an assembly that is removably engageable with a work area for supporting a walking surface along which a worker can conveniently travel.

The assembly includes at least one support unit including a first elongated support arm that is positionable against an outer edge portion of the work area wherein the first support arm extends along a substantially vertical axis. Such support units are preferably laterally spaced along the outer edge portion of the work area and are maintained at a fixed spatial relationship during working conditions. A handle may be attached to a top end portion of the first support member for advantageously assisting a worker to maneuver along the board.

A second elongated support arm is cantilevered and secured to the first support arm wherein the second support arm extends substantially orthogonal thereto. Such a second support arm has opposed front and rear end portions respectively spaced from the first support arm such that the front end portion abuts and spans across at least two support joists (described herein below) extending beneath the work area.

A joist-supporting arm is removably engageable with the front end portion and extends substantially orthogonal thereto such that the first support arm, the second support arm, and the joist-supporting arm, are aligned along three distinct and non-coplanar axes respectively. Such axes are defined along an x-axis, y-axis, and z-axis respectively. Preferably, the joist-supporting member can be pivoted along a selected arcuate path for effectively engaging selected ones of the work area support joists.

An upper support arm is cantilevered and secured to the first support arm. Such an upper support arm extends substantially parallel to the second support arm for advantageously engaging a top surface of the work area. The upper support arm includes a support member having opposed end portions secured thereto and to the first support member for maintaining the upper support arm at a substantially stable position during working conditions. Such an upper support arm further includes a plurality of L-shaped members mated along a common edge thereof.

An elongated board is conveniently positionable between adjacently disposed ones of the rear end portions so that the board can advantageously be maintained at a substantially stable position during working conditions. The front end portion exerts an upward force against the work area joists while the upper support arm exerts a downward force against a top surface of the work area such that the upward and downward forces become balanced when an operator stands on the board.

The assembly may further include a plurality of support brackets having opposed end portions adjustably secured to a lower end portion of the first support arm and selected portions of the second support arm such that operating forces acting thereagainst can be maintained at equilibrium.

The assembly preferably further includes a handrail support member including a mounting bracket secured to the rear end portion of the second support arm. Such a handrail support member extends upwardly from the mounting bracket and is provided with a U-shaped tip for receiving and supporting a handrail therein for advantageously preventing a worker from stepping rearwardly off the board.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
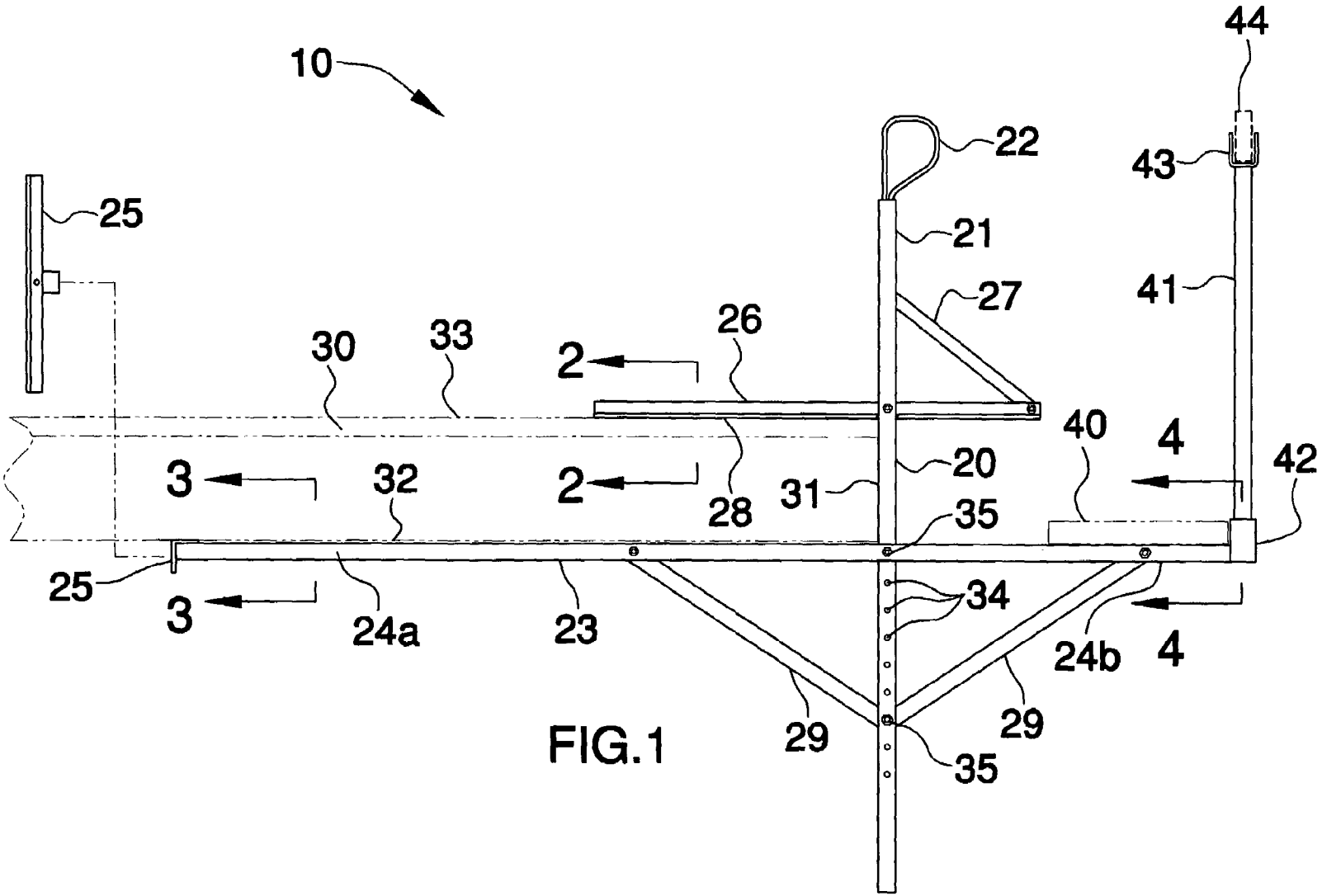
FIG. 1 is a side elevational view showing an outrigger assembly for supporting a platform adjacent to a work area, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-5 by the reference numeral 10 and is intended to provide an outrigger assembly for supporting a platform adjacent to a work area. It should be understood that the assembly 10 may be used to provide support during the construction of many different types of structures and should not be limited to only deck and porches.

Figure 5:
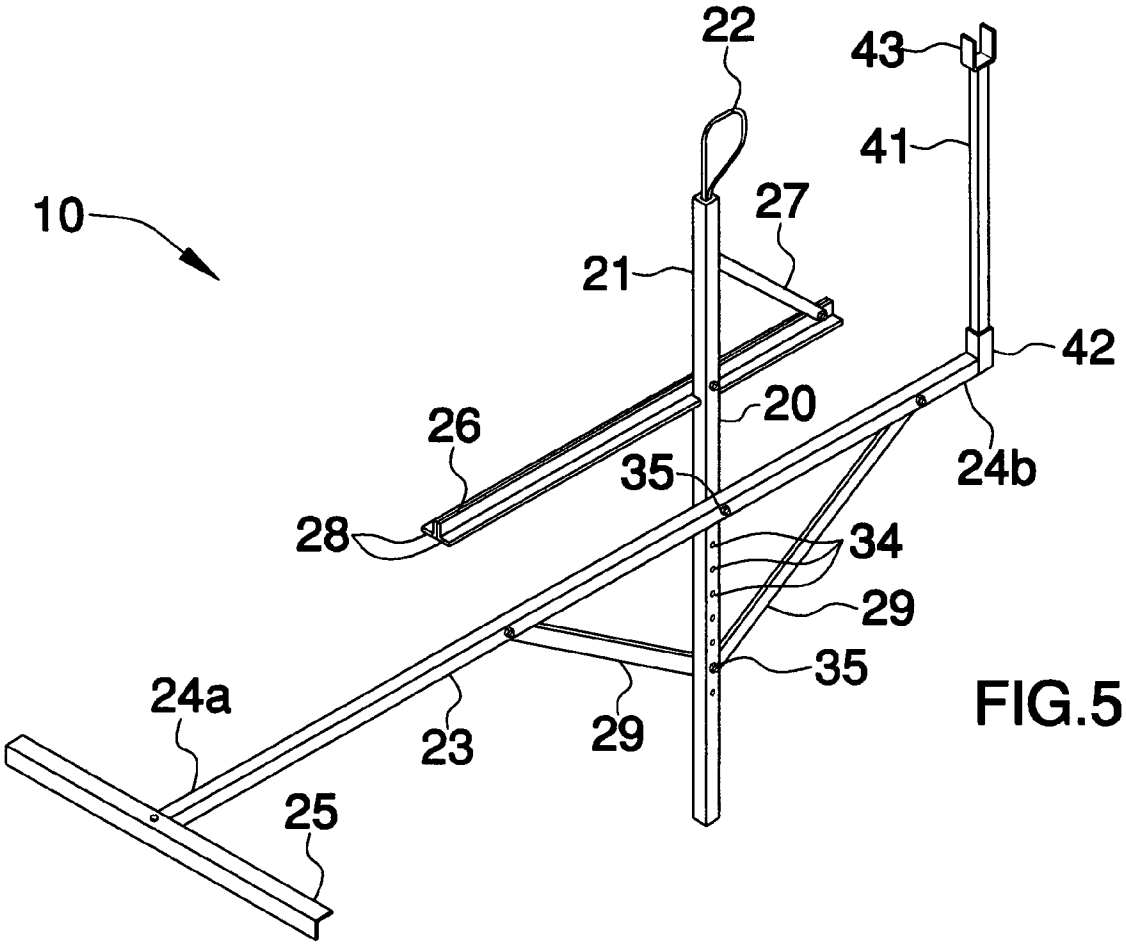
FIG. 5 is a perspective view of the assembly shown in FIG. 1.

Referring initially to FIGS. 1 and 5, the assembly 10 includes at least one support unit 20 including a first elongated support arm 21 that is positionable against an outer edge portion 31 of the work area 30 wherein the first support arm 21 extends along a substantially vertical axis. Such support units 20 are laterally spaced along the outer edge portion 31 of the work area 30 and are maintained at a fixed spatial relationship during working conditions.

A handle 22 is attached to a top end portion of the first support member 21 for advantageously assisting a worker to maneuver along the board 40 (described herein below) more steadily and rapidly, thus shortening the amount of time needed to complete a task and resulting in better productivity. The first elongated support arm 21 further has a plurality of apertures 34 formed therein for receiving thread fastening members 35 therethrough in order to effectively fasten the second support arm 23 (described herein below) and the upper support arm 25 (described herein below) thereto. Such apertures 34 advantageously allow the second support arm 25 to be vertically adjusted in relation to the upper support arm 25 such that the assembly 10 can be positioned on support joists 32 of varying widths for optimum stability.

Referring to FIG. 1, a second elongated support arm 23 is cantilevered and secured to the first support arm 21 wherein the second support arm 23 extends substantially orthogonal thereto. Such a second support arm 23 has opposed front 24*a* and rear 24*b* end portions respectively spaced from the first support arm 21 such that the front end portion 24*a* abuts and spans across at least two support joists 32 (described herein below) extending beneath the work area 30.

Figure 3:
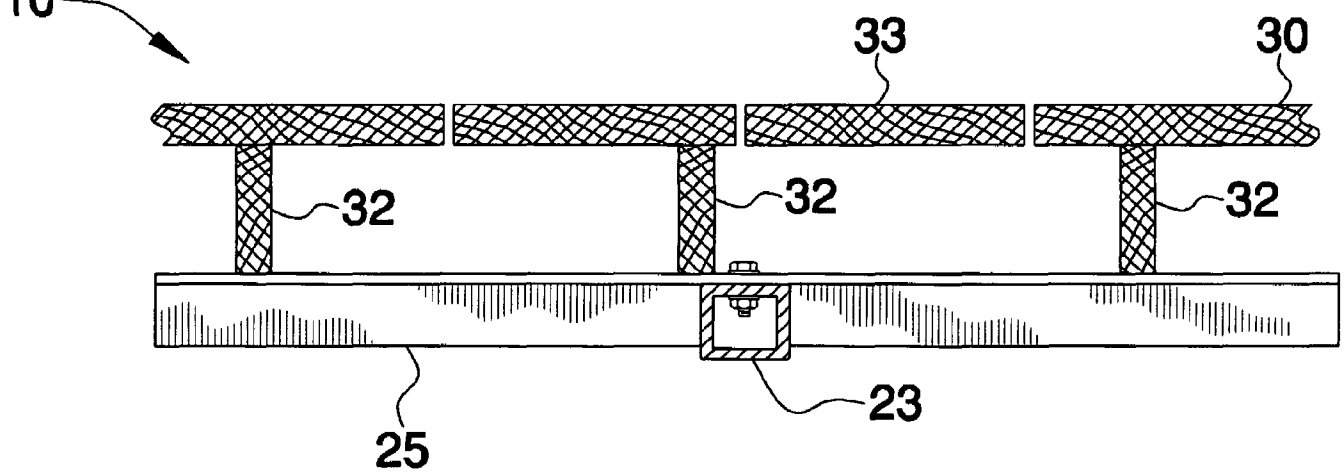
FIG. 3 is a cross-sectional view of the upper support arm shown in FIG. 1, taken along line 3-3.

Referring to FIGS. 1, 3, and 5, a joist-supporting arm 25 is removably engageable with the front end portion 24*a* and extends substantially orthogonal thereto such that the first support arm 21, the second support arm 23, and the joist-supporting arm 25, are aligned along three distinct and non-coplanar axes respectively. Such axes are defined along an x-axis, y-axis, and z-axis respectively. The joist-supporting member 25 can be pivoted along a selected arcuate path for effectively engaging selected ones of the work area support joists 32. The pivoting feature of the joist support arm 25 is particularly advantageous in circumstances where the joist supports 32 run orthogonal to the outer edge portion 31 of the work area 30, thus allowing for proper positioning and functioning of the assembly 10.

Figure 2:
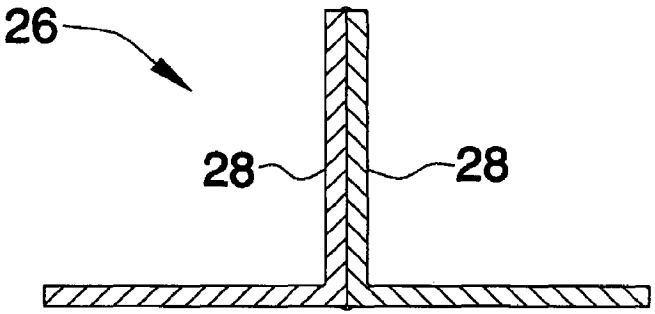
FIG. 2 is a cross-sectional view of the first elongated support arm show in FIG. 1, taken along line 2-2.

Referring to FIGS. 1, 2, and 5, an upper support arm 26 is cantilevered and secured to the first support arm 21. Such an upper support arm 26 extends substantially parallel to the second support arm 23 for advantageously engaging a top surface 33 of the work area 30. The upper support arm 26 includes a support member 27 having opposed end portions secured thereto and to the first support member 21 for maintaining the upper support arm 26 at a substantially stable position during working conditions. Such an upper support arm 26 further includes a plurality of L-shaped members 28 mated along a common edge thereof. The plurality of L-shaped members 28 effectively disperses the upward forces experienced by the upper support arm 26 in a manner superior to that of a single L-shaped member, and thus, advantageously improves the structural integrity of the assembly 10.

Referring to FIG. 1, an elongated board 40 is conveniently positionable between adjacently disposed ones of the rear end portions 24*b* so that the board 40 can advantageously be maintained at a substantially stable position during working conditions, thus providing a safe and sufficient walkway for workers to move along. The front end portion 24*a* exerts an upward force against the work area joists 32 while the upper support arm 26 exerts a downward force against a top surface 33 of the work area 30 such that the upward and downward forces become balanced when an operator stands on the board 30. This further secures the assembly 10 during operating conditions.

Referring to FIGS. 1 and 5, the assembly 10 further includes a plurality of support brackets 29 having opposed end portions adjustably secured to a lower end portion of the first support arm 21 and selected portions of the second support arm 23 such that operating forces acting thereagainst can be maintained at equilibrium. Such support brackets advantageously prevent the rear end portion 24*b* of the second support arm 23 from bending below a horizontal plane of the support joists 32, allowing for a safer walking surface on the board 40.

Figure 4:
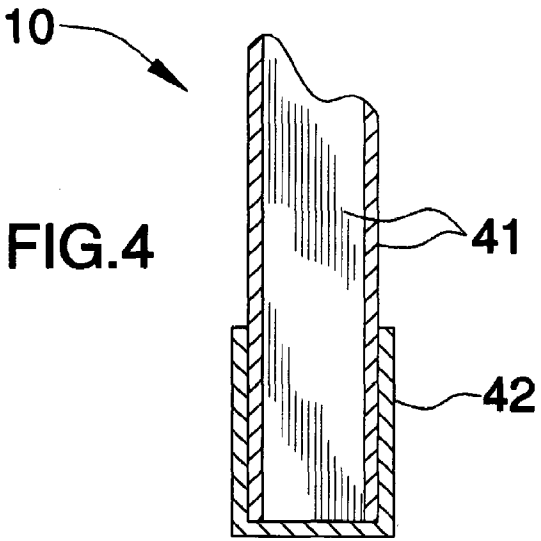
FIG. 4 is a cross-sectional view of the assembly shown in FIG. 1, taken along line 4-4.

Referring to FIGS. 1, 4 and 5, the assembly 10 further includes a handrail support member 41 including a mounting bracket 42 secured to the rear end portion 24*b* of the second support arm 23. Such a handrail support member 41 extends upwardly from the mounting bracket 42 and is provided with a U-shaped tip 43 for receiving and supporting a handrail 44 therein for advantageously preventing a worker from stepping rearwardly of the board 40. The handrail 44 further assists a worker in maintaining their balance on the board 40 in cooperation with the handle 22, thus improving the safety features of the assembly 10.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An assembly being removably engageable with a work area for supporting a walking surface along which a worker can travel, said assembly comprising:

at least one support unit comprising a first elongated support arm being positionable against an outer edge portion of the work area wherein said first support arm extends along a substantially vertical axis, a second elongated support arm cantilevered and secured to said first support arm wherein said second support arm extends substantially orthogonal thereto, said second support arm having opposed front and rear end portions respectively spaced from said first support arm such that said front end portion abuts and spans across at least two support joists extending beneath the work area, a joist-supporting arm removably engageable with said front end portion and extending substantially orthogonal thereto such that said first support arm and said second support arm and said joist-supporting arm are aligned along three distinct and non-coplanar axes respectively, and an upper support arm cantilevered and secured to said first support arm, said upper support arm extending substantially parallel to said second support arm for engaging a top surface of the work area, said upper support arm including a support member having opposed end portions secured thereto and to said first support member for maintaining said upper support arm at a substantially stable position during working conditions;

wherein an elongated board is positionable between adjacently disposed ones of said rear end portions so that the board can be maintained at a substantially stable position during working conditions, said front end portion for exerting an upward force against the work area joists while said upper support arm exerts a downward force against a top surface of the work area such that the upward and downward forces become balanced when an operator stands on the board.

2. The assembly of claim 1, wherein said at least one support unit comprises a plurality of support units laterally spaced along the outer edge portion of the work area and are maintained at a fixed spatial relationship during working conditions.

3. The assembly of claim 1, further comprising: a plurality of support brackets having opposed end portions adjustably secured to a lower end portion of said first support arm and selected portions of said second support arm such that operating forces acting thereagainst can be maintained at equilibrium.

4. The assembly of claim 1, further comprising: a handle attached to a top end portion of said first support member for assisting a worker to maneuver along the board.

5. The assembly of claim 1, further comprising: a handrail support member including a mounting bracket secured to said rear end portion of said second support arm, said handrail support member extending upwardly from said mounting bracket and being provided with a U-shaped tip for receiving and supporting a handrail therein and for preventing a worker from stepping rearwardly of the board.

6. The assembly of claim 1, wherein said joist-supporting arm can be pivoted along a selected arcuate path for engaging selected ones of the work area support joists.

7. An assembly being removably engageable with a work area for supporting a walking surface along which a worker can travel, said assembly comprising:

at least one support unit comprising a first elongated support arm being positionable against an outer edge portion of the work area wherein said first support arm extends along a substantially vertical axis, a second elongated support arm cantilevered and secured to said first support arm wherein said second support arm extends substantially orthogonal thereto, said second support arm having opposed front and rear end portions respectively spaced from said first support arm such that said front end portion abuts and spans across at least two support joists extending beneath the work area, a joist-supporting arm removably engageable with said front end portion and extending substantially orthogonal thereto such that said first support arm and said second support arm and said joist-supporting arm are aligned along three distinct and non-coplanar axes respectively, the axes being defined along an x-axis, y-axis, and z-axis respectively, and an upper support arm cantilevered and secured to said first support arm, said upper support arm extending substantially parallel to said second support arm for engaging a top surface of the work area, said upper support arm including a support member having opposed end portions secured thereto and to said first support member for maintaining said upper support arm at a substantially stable position during working conditions;

wherein an elongated board is positionable between adjacently disposed ones of said rear end portions so that the board can be maintained at a substantially stable position during working conditions, said front end portion for exerting an upward force against the work area joists while said upper support arm exerts a downward force against a top surface of the work area such that the upward and downward forces become balanced when an operator stands on the board.

8. The assembly of claim 7, wherein said at least one support unit comprises a plurality of support units laterally spaced along the outer edge portion of the work area and are maintained at a fixed spatial relationship during working conditions.

9. The assembly of claim 7, further comprising: a plurality of support brackets having opposed end portions adjustably secured to a lower end portion of said first support arm and selected portions of said second support arm such that operating forces acting thereagainst can be maintained at equilibrium.

10. The assembly of claim 7, further comprising: a handle attached to a top end portion of said first support member for assisting a worker to maneuver along the board.

11. The assembly of claim 7, further comprising: a handrail support member including a mounting bracket secured to said rear end portion of said second support arm, said handrail support member extending upwardly from said mounting bracket and being provided with a U-shaped tip for receiving and supporting a handrail therein and for preventing a worker from stepping rearwardly of the board.

12. The assembly of claim 7, wherein said joist-supporting arm can be pivoted along a selected arcuate path for engaging selected ones of the work area support joists.

13. An assembly being removably engageable with a work area for supporting a walking surface along which a worker can travel, said assembly comprising:

at least one support unit comprising a first elongated support arm being positionable against an outer edge portion of the work area wherein said first support arm extends along a substantially vertical axis, a second elongated support arm cantilevered and secured to said first support arm wherein said second support arm extends substantially orthogonal thereto, said second support arm having opposed front and rear end portions respectively spaced from said first support arm such that said front end portion abuts and spans across at least two support joists extending beneath the work area, a joist-supporting arm removably engageable with said front end portion and extending substantially orthogonal thereto such that said first support arm and said second support arm and said joist-supporting arm are aligned along three distinct and non-coplanar axes respectively, the axes being defined along an x-axis, y-axis, and z-axis respectively, and an upper support arm cantilevered and secured to said first support arm, said upper support arm extending substantially parallel to said second support arm for engaging a top surface of the work area, said upper support arm including a support member having opposed end portions secured thereto and to said first support member for maintaining said upper support arm at a substantially stable position during working conditions, said upper support arm including a plurality of L-shaped members mated along a common edge thereof;

wherein an elongated board is positionable between adjacently disposed ones of said rear end portions so that the board can be maintained at a substantially stable position during working conditions, said front end portion for exerting an upward force against the work area joists while said upper support arm exerts a downward force against a top surface of the work area such that the upward and downward forces become balanced when an operator stands on the board.

14. The assembly of claim 13, wherein said at least one support unit comprises a plurality of support units laterally spaced along the outer edge portion of the work area and are maintained at a fixed spatial relationship during working conditions.

15. The assembly of claim 13, further comprising: a plurality of support brackets having opposed end portions adjustably secured to a lower end portion of said first support arm and selected portions of said second support arm such that operating forces acting thereagainst can be maintained at equilibrium.

16. The assembly of claim 13, further comprising: a handle attached to a top end portion of said first support member for assisting a worker to maneuver along the board.

17. The assembly of claim 13, further comprising: a handrail support member including a mounting bracket secured to said rear end portion of said second support arm, said handrail support member extending upwardly from said mounting bracket and being provided with a U-shaped tip for receiving and supporting a handrail therein and for preventing a worker from stepping rearwardly of the board.

18. The assembly of claim 13, wherein said joist-supporting arm can be pivoted along a selected arcuate path for engaging selected ones of the work area support joists.

* * * * *